United States Patent [19]

Buchheit

[11] 4,044,585

[45] Aug. 30, 1977

[54] ENTRY ROLLERWAY FOR A COOLING BED FOR ELONGATE ROLLED STOCK

[75] Inventor: Otto K. Buchheit, St. Ingbert, Germany

[73] Assignee: Moeller & Neumann GmbH, St. Ingbert, Saar, Germany

[21] Appl. No.: 692,569

[22] Filed: June 3, 1976

[30] Foreign Application Priority Data

June 5, 1975 Germany ..... 2525014

[51] Int. Cl.[2] ..... B21B 43/00

[52] U.S. Cl. ..... 72/201; 72/251; 72/252

[58] Field of Search ..... 72/201, 202, 250, 251, 72/252, 419; 266/259, 260

[56] References Cited

U.S. PATENT DOCUMENTS

| | | | |
|---|---|---|---|
| 1,929,487 | 10/1933 | Feller | 72/419 |

FOREIGN PATENT DOCUMENTS

| | | | |
|---|---|---|---|
| 1,427,868 | 3/1969 | Germany | 72/251 |
| 1,811,174 | 6/1970 | Germany | 72/201 |
| 2,026,896 | 6/1970 | Germany | 72/252 |
| 893,526 | 4/1962 | United Kingdom | 72/252 |
| 900,458 | 7/1962 | United Kingdom | 72/252 |

*Primary Examiner*—E. M. Combs
*Attorney, Agent, or Firm*—John J. Dennemeyer

[57] ABSTRACT

An entry rollerway for a cooling bed for elongate rolled stock in which all parts necessary for guiding and laterally ejecting the rods are carried by lantern-shaped cast members which also constitute the bearings for the rollerway rollers, so that the long support structure or the frame-like understructure previously used in entry rollerways is avoided.

5 Claims, 2 Drawing Figures

ENTRY ROLLERWAY FOR A COOLING BED FOR ELONGATE ROLLED STOCK

Figure 1:
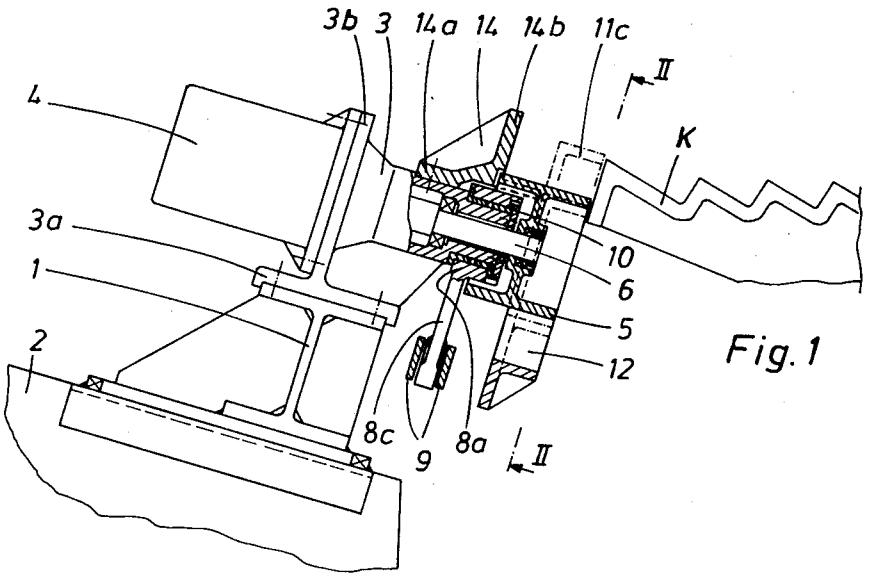

This invention relates to an entry rollerway for a cooling bed for elongate rolled stock, for example rods or bars.

An entry rollerway serves to lift rods or bars which travel into a groove off the rollerway rollers by raising lifter members according to British patent specification No. 1,010,833 or by pivoting lifter flaps according to U.S. specification Ser. No. 1,929,487, whereby a braking process is initiated and the rods are ejected laterally into the first groove of an adjacent cooling bed.

Because of the numerous movable parts and the work necessary for the production thereof, entry rollerways are articles which require high expenditure for wages and the acquisition of which is accordingly expensive. Also, the constructional expenditure depends on the entry speed of the rods insofar as the braking distances and thus also the length of the entry rollerways increase with the continuously increasing rolling speeds.

It was found that the previous manner of construction of the under-structure of an entry rollerway is the reason for the high manufacturing cost of an entry rollerway because of the comprehensive machining work which is necessary for the guidance of lifter elements. Namely, heretofore long cast members were used for mounting thereon the rollerway rollers and the pivot axes of bell cranks for actuating the lifter elements, as well as for forming stationary bottom and wall members of the entry groove, and in addition to the bearing bores some guide faces on the cast members, for example for lifter members, had to be subjected to finishing operations. These operations were necessary for the reason that long cast members having relatively thin wall parts cannot be cast with sufficient accuracy. One example of a frame-like support structure of an entry rollerway is illustrated in U.S. Pat. No. 1,010,833

In the entry rollerway of the U.S. specification Ser. No. 1,929,487 also such a frame-like support structure must be present which has a plurality of recesses for the mounting of the rollerway rollers and the pivot axes of lifter flaps and which is also adapted to form bottom and wall members.

Summarisingly, it can thus be stated that the previous construction of the under-structure of entry rollerways comprises only long frame parts which extend over a plurality of successively disposed rollerway rollers and which accordingly can be machined only with difficulty. The invention is based on the problem to simplify constructionally the construction of an entry rollerway of cooling beds for elongate rolled stock with the aim to facilitate machining operations of support structures and to make at least some such machining work superfluous.

The invention consists in an entry rollerway for a cooling bed for elongate rolled stock, for example, rods of bars, comprising an elongate carrier means and a plurality of lantern-shaped cast members mounted on said carrier means at regular spaced locations, elongate cast members supported on adjacent ones of said lantern-shaped cast members and forming bottom and wall members defining an entry groove for said rolled stock, each of said lantern-shaped cast members supporting a rollerway roller means extending into said entry groove, and a pivot axis means, said pivot axis means having a bell crank means rotatably mounted thereon, a plurality of lifter elements extending into said entry groove, two adjacent bell crank means having one lifter element pivotally mounted thereon, an actuator rod means connecting all said bell crank means and actuable to rotate said bell crank means from a position in which said lifter elements are flush with said bottom members of said entry groove to a raised position in which said lifter elements can eject rolled stock to said cooling bed.

Thus in our entry rollerways constructed in accordance with the previous frame-like common support structure is divided into individual lantern-like cast members each of which is provided with a supporting foot and each of which is constructed as a bearing support for one rollerway roller, as pivot axis support for one bell crank, and as support for bottom and wall members which form the entry groove. As to the lantern-like cast members each of which is constructed to support a pivot axis for a bell crank, the U.S. specification Ser. No. 1,929,487 illustrates already bell cranks constructed to form lifter flaps and mounted on the roller axes without however the common support structure being divided thereby in the sense of the invention into individual elements, since in addition to the lifter flaps mounted on the roller axes, yet further lifter flaps mounted on separate pivot axes are provided between successive rollerway rollers.

Owing to the division according to the invention of the support structure of an entry rollerway into individual support elements each supporting one rollerway roller, one bell crank and one lifter member and under certain circumstances- in the case of individual drive of the rollerway rollers- one driving motor, the considerable advantage is obtained that the individual support elements, that is to say, the lantern-shaped cast members, can be machined in a cost-saving manner on small machine tools as they are relatively small machine parts. Furthermore, the need for planing or milling long members, for example, the bottom members and the wall members of the entry groove, is avoided since these parts are of short length and thus can be cast accurately that they need not be machined any more. The bottom and wall members need merely be so long that, for obtaining stable support, they bridge two successive lantern-like cast members to which they are securely screwed. Apart from the reduced machining costs the invention results also in a saving of material so that in the end an entry rollerway according to the invention is reduced in price by approximately 60%.

In entry rollerways with slidable lifter members as lifter elements, each lifter member bridging the gap between two rollerway rollers is connected to two arms of two bell cranks. The invention provides for this that the slidable lifter members are always connected to two corresponding arms of adjacent bell cranks and, by means of a projecting extension, bridge the gaps between altogether three rollerway rollers, the lifter members being so constructed that in the region of the respective central roller, each is downwardly deformed to allow for the lifter stroke provided. It is attained thereby that the two gaps between three successive rollerway rollers are bridged by always one lifter member.

According to a further proposal of the invention a compact manner of construction in the direction of the roller axis is obtained by the fact that the hubs of the bell cranks are mounted at the ends of the lantern-shaped cast members and the arms of the bell cranks are cast to the hubs eccentrically with respect to the support foot of the cast members in such a manner than the jacket of each rollerway roller covers partly the associated hub.

Figure 2:
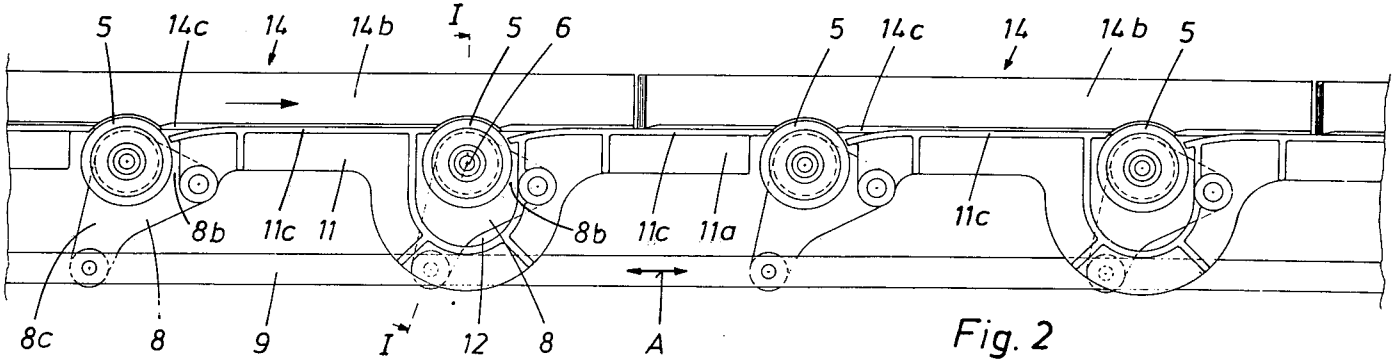

One constructional example of an entry rollerway according to the invention with slidable lifter members as lifter elements is described below with reference to the accompanying drawings, in which:

FIG. 1 illustrates a partial vertical section through the entry rolle way in the region of the entry groove proper, the remaining parts being in side view, and FIG. 2 illustrates a side view transverse to the line II—II in FIG. 1.

An entry rollerway for a grate cooling bed K is illustrated in FIG. 1 and is disposed inclined downwardly towards the cooling bed. The rollerway rests on a stiffened carrier 1 which is continuous or is divided into individual members and which is supported on a foundation 2. In place of a cast rollerway frame carried in prior art constructions by the carrier 1 to serve as support structure for the components parts of the entry rollerway, the present support structure consists of a plurality of individual lantern-shaped cast members 3 which are rigidly connected to the carrier 1 by means of a support foot 3*a*. Each lantern-shaped cast member 3 has a flange 3*b* which extends perpendicularly to the support foot 3*a* and to which is fixed a driving motor 4 for a rollerway roller 5. Each rollerway roller 5 is mounted on a roller axis 6 which is mounted in the lantern-shaped cast member 3. The rollerway rollers 5 are thus mounted in an overhanging manner. One lantern-shaped cast member 3 is provided for each rollerway roller.

The lantern-shaped cast members 3, provide the pivot axes for bell cranks 8 (FIG. 2) in that hubs 8*a* of the bell cranks are each mounted at the end of a respective lantern-shaped cast member 3. The hubs 8*a* are axially secured by means of discs 10 at their outer ends. Each bell crank 8 has a shorter arm 8*b* and a longer downwardly extending arm 8*c*. All arms 8*c* are pivotally connected to an actuator rod 9 which is reciprocably adjustable in the direction of the arrow A. The shorter arms 8*b* of the bell cranks actuate the slidable lifter members 11 in that two arms 8*b* of successive bell cranks 8 are pivotally connected always to one slidable lifter member 11. The slidable lifter members 11 are so constructed that each by itself bridges the two gaps between altogether three successive rollerway rollers 5, namely because of a projecting extension 11*a*. Since — viewed from a central rollerway roller 5 — each slidable lifter member 11, 11*a* thus extends towards both adjacent rollerway rollers, each slidable lifter member must be provided in the region of the respective central rollerway roller with a downwardly projecting deformation 12. In the cross-section according to FIG. 1 which is taken on the line I—I in FIG. 2, only the lower deformation 12 of a slidable lifter member 11 can be seen in section, since the surface 11*c* dropping towards the cooling bed K is interrupted in the region of each rollerway roller 5, as shown in FIG. 2. In FIG. 1 the surface 11*c* of a slidable lifter member lifting a rod is illustrated in a raised position by dash-dotted lines.

It is clear from FIG. 1 that the arms of each bell crank 8 are cast on their hub 8*a* eccentrically with respect to the support foot 3*a* of the respective lantern-shaped cast member 3. In this manner the jacket of each rollerway roller 5 can partly overlap the associated hub 8*a*, a compact construction resulting therefrom.

The entry groove proper of each entry rollerway is formed by stationary bottom plates, the surfaces 11*c* adjacent the cooling bed K of the downwardly controlled slidable lifter members 11, an upwardly directed guide face adjacent the cooling bed for the slidable lifter member and a wall member lying opposite the cooling bed. The stationary bottom plate as well as the surfaces 11*c* of the lifter members are each interrupted in the region of the rollerway rollers 5 in order that rod material which enters into the entry groove can be driven forwardly by the rollerway rollers 5 when the lifter members 11 are in the lowered position thereof. Since according to the invention the lantern-shaped cast members 3 are the only support elements for all component parts of an entry rollerway, the fixed bottom and wall parts are formed by elongate cast members 14 (FIG. 1) which are fixed to the top of the lantern-shaped cast members 3 by means of eyes 14*a* cast on. Each elongate cast member 14 has an upwardly extending wall 14*b* and a bottom member 14*c* which is cast at a right-angle thereto and which lies in FIG. 1 behind the roller 5 since the fixed bottom plates of an entry groove are interrupted in the region of each rollerway roller. The fixed bottom parts 14*c* are inclined downwardly towards the cooling bed K and are flush with the surfaces 11*c* of the lifter members 11 when the latter are in their lower position according to FIG. 2.

The elongate cast members 14 constuting the fixed bottom and wall member each rest on two successive lantern-shaped cast members 3 and each extends beyond them to the centre of the gap between two rollerway rollers 5. Therefore, they have a limited length and can be cast accurately that further machining of the bottom and wall members is unnecessary.

The manner of operation of an entry rollerway according to the invention need be explained only briefly. When a roller rod or bar enters into the entry groove defined by the axial length of the rollerway rollers 5, the slidable lifter members 11 are controlled downwardly so that the rod or bar travel towards the right because of the inclincation of the rollerway rollers and the bottom faces 14*c* and 11*c*, until it comes into engagement with a guide face adjacent the cooling bed. The sliding or braking time for the rod or bar begins when the actuator rod 9 is pulled towards the right (in FIG. 2) and the slidable lifter members 11 are controlled into the raised position illustrated in FIG. 1 by dash-dotted lines. In this raised position the rod is ejected into the first stationary groove of the cooling bed K where it comes to rest, and is removed therefrom by oscillating gratings not illustrated. While the slidable lifter members 11 are controlled into the raised position, the next rod enters into the entry groove on the left adjacent the slidable lifter member, whereupon the lifter members are controlled downwardly again and the operating cycle begins again.

I claim:

1. An entry rollerway for a cooling bed for elongate rolled stock, for example, rods or bars, comprising:

an elongated carrier means;

a plurality of lantern-shaped cast members mounted on said elongated carrier means at spaced locations therealong;

elongated cast members supported only on adjacent ones of said lantern-shaped cast members, and including bottom and side wall portions defining an entry groove for said rolled stock;

a driven roller means carried by each of said lantern-shaped cast members, and arranged to extend into said entry groove generally transversely thereof;

pivot axis means also carried by each of said lantern-shaped cast members, each pivot axis means having a bell crank means rotatably mounted thereon;

a lifter element disposed to extend between each pair of said bell crank means, and pivotally connected thereto; and an actuator rod means connecting all of said bell crank means, and operable to rotate said bell crank means from a position in which said lifter element(s) are flush with said bottom wall portions of said entry groove to a raised position in which said lifter element(s) eject rolled stock from said entry groove to said cooling bed.

2. An entry rollerway as recited in claim 1, wherein the axis of rotation of each of said driven roller means is disposed concentrically of its associated pivot axis means.

3. An entry rollerway as recited in claim 2, wherein each of said lifter elements is connected to the bell crank means on two adjacent lantern-shaped cast members, and includes a main portion that extends between said two lantern-shaped cast members, and an extension portion that extends to a next-adjacent lantern-shaped cast member, whereby each lifter element bridges the gap between three successive driven roller means, said main portion being connected with said extension portion by a U-shaped portion located in the region of the central one of said three successive driven rollers, to accommodate lifting of said lifter element.

4. An entry rollerway as recited in claim 2, wherein said lantern-shaped cast members each includes:

a support foot attachable to said carrier, and carrying a flange thereon; and a generally cylindrical portion projecting from said flange, and having an axial bore therethrough;

said driven roller being carried by a roller axis rotatably mounted to extend through said axial bore;

said elongated cast members being supported by a first part of said generally cylindrical portion; and the remaining part of said generally cylindrical portion defining said pivot axis means, for mounting said bell crank means.

5. An entry rollerway as recited in claim 4, wherein each of said bell crank means includes:

a hub portion rotatably mounted on said remaining part of said generally cylindrical portion of said lantern-shaped cast member, between said first part thereof and said driven roller means; and a pair of arms arranged to project from said hub portion, one of said arms being pivotally connected to said lifter element, and the other being pivotally connected to said actuator rod means, said driven roller means including a hollow cylindrical roller arranged to partially overlap said hub portion, and said pair of arms being connected to said hub portion at the end thereof opposite said hollow cylindrical roller, whereby to accommodate said overlap.

* * * * *